US007494120B2

(12) United States Patent
Shimizu et al.

(10) Patent No.: US 7,494,120 B2
(45) Date of Patent: Feb. 24, 2009

(54) IMAGE GENERATING APPARATUS

(75) Inventors: Daisuke Shimizu, Daito (JP); Daisuke Takasaka, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 111 days.

(21) Appl. No.: 11/455,752

(22) Filed: Jun. 20, 2006

(65) Prior Publication Data

US 2007/0040321 A1 Feb. 22, 2007

(30) Foreign Application Priority Data

Aug. 22, 2005 (JP) ..... 2005-239568

(51) Int. Cl.
*B65H 1/18* (2006.01)
*B65H 1/08* (2006.01)

(52) U.S. Cl. ..... 271/152; 271/153; 271/154; 271/126; 271/127; 271/147

(58) Field of Classification Search ..... 271/145, 271/147, 152, 153, 154, 155, 127, 126, 122, 271/125
See application file for complete search history.

(56) References Cited

U.S. PATENT DOCUMENTS 4,888,617 A * 12/1989 Okuzawa ..... 355/400
5,076,563 A * 12/1991 Namba et al. ..... 271/10.09
5,118,090 A * 6/1992 Sonoda et al. ..... 271/10.13
5,213,426 A * 5/1993 Ewing ..... 400/624
5,228,673 A * 7/1993 Osonoe ..... 271/10.01
5,347,350 A * 9/1994 Nakahata et al. ..... 399/23
5,386,983 A * 2/1995 Ando ..... 271/118
5,474,288 A * 12/1995 Lo et al. ..... 271/110
5,582,399 A * 12/1996 Sugiura ..... 281/10.11
5,779,234 A * 7/1998 Tomii et al. ..... 271/3.2
5,944,430 A * 8/1999 Myung ..... 400/624
5,954,327 A * 9/1999 Lin et al. ..... 271/110
6,000,689 A * 12/1999 Furuki et al. ..... 271/10.11
6,022,015 A * 2/2000 Matsumoto ..... 271/121
6,050,564 A * 4/2000 Tamehira ..... 271/114
6,105,954 A * 8/2000 Magee et al. ..... 271/10.03
6,378,858 B1 * 4/2002 Suga ..... 271/10.01
6,550,759 B2 * 4/2003 Kotaka et al. ..... 271/10.11
6,880,822 B2 * 4/2005 Fukushima et al. ..... 271/157
7,182,336 B2 * 2/2007 Fukushima et al. .... 271/265.01
7,182,337 B2 * 2/2007 Sasai et al. ..... 271/265.01
7,222,847 B2 * 5/2007 Yamamoto ..... 271/153

(Continued)

FOREIGN PATENT DOCUMENTS

JP 2-305727 A 12/1990

(Continued)

*Primary Examiner*—Patrick H Mackey
*Assistant Examiner*—Luis Gonzalez
(74) *Attorney, Agent, or Firm*—Crowell & Moring LLP

(57) ABSTRACT

An image generating apparatus capable of effectively suppressing double paper feeding and reducing the number of components is obtained. This image generating apparatus comprises a paper feed roller feeding papers, a push-up member pressing the papers against the paper feed roller and a control portion controlling driving of the paper feed roller and the push-up member. The control portion carries the papers in a paper feed direction by rotating the paper feed roller, thereafter carries the papers oppositely to the paper feed direction by a prescribed distance while lifting the push-up member, and thereafter lowers the push-up member.

14 Claims, 10 Drawing Sheets

U.S. PATENT DOCUMENTS

| | | | | |
|---|---|---|---|---|
| 2001/0019192 | A1* | 9/2001 | Yen et al. | 271/117 |
| 2002/0036377 | A1* | 3/2002 | Togashi | 271/127 |
| 2003/0156150 | A1* | 8/2003 | Hayashi et al. | 347/19 |
| 2005/0040588 | A1* | 2/2005 | Chang | 271/126 |
| 2005/0087921 | A1* | 4/2005 | Aoki et al. | 271/126 |

FOREIGN PATENT DOCUMENTS

| | | | |
|---|---|---|---|
| JP | 6-64769 | A | 3/1994 |
| JP | 2003-26348 | A | 1/2003 |

* cited by examiner

IMAGE GENERATING APPARATUS

BACKGROUND OF THE INVENTION

1. Field of the Invention

The present invention relates to an image generating apparatus, and more particularly, it relates to an image generating apparatus comprising a feeder for feeding papers.

2. Description of the Background Art

A feeder for feeding papers and an image generating apparatus comprising such a feeder are known in general, as disclosed in Japanese Patent Laying-Open Nos. 02-305727 (1990), 06-64769 (1994) and 2003-26348, for example.

The aforementioned Japanese Patent Laying-Open No. 02-305727 describes the structure of a feeder capable of suppressing simultaneous feeding of a plurality of papers in paper feeding. In this feeder, a sheet separation roller rotating oppositely to the direction of rotation of a paper feed belt is arranged on a position opposite to the paper feed belt. In paper feeding, the feeder presses papers with the paper feed belt and the sheet separation roller, so that the sheet separation roller carries papers other than a fed one oppositely to a paper feed direction. After separating the papers in this manner, the feeder releases the papers from the pressing force of the sheet separation roller. Thus, the feeder separates the papers one by one from each other, while carrying only the fed paper in the paper feed direction with the paper feed belt. This feeder described in Japanese Patent Laying-Open No. 02-305727 is provided with a press roller, a rotating arm, a spring, a wire, a solenoid and the like, in order to press the sheet separation roller against the papers or separate the same from the papers (release the papers from the pressing force of the sheet separation roller). The feeder is further provided with a timer for measuring the timing for releasing the papers from the pressing force of the sheet separation roller.

The aforementioned Japanese Patent Laying-Open No. 06-64769 describes the structure of a feeder capable of suppressing simultaneous feeding of a plurality of papers in paper feeding, similarly to the aforementioned Japanese Patent Laying-Open No. 02-305727. In this feeder, a separation roller rotating oppositely to the rotational direction of a paper feed roller is arranged on a position opposite to the paper feed roller. In paper feeding, the feeder presses papers against the paper feed roller and the separation roller with compression springs, so that the separation roller carries papers other than a fed one oppositely to a paper feed direction. After separating the papers in this manner, the feeder releases the papers from the pressing force of the separation roller. Thus, the feeder separates the papers one by one from each other, while carrying only the fed paper in the paper feed direction with the paper feed roller. This feeder described in Japanese Patent Laying-Open No. 06-64769 is provided with two compression springs, a support member, a lever, a solenoid and the like, in order to press the separation roller against the papers or separate the same from the papers (release the papers from the pressing force of the separation roller). The feeder is also provided with a paper sensor for sensing the timing for releasing the papers from the pressing force of the separation roller.

The aforementioned Japanese Patent Laying-Open No. 2003-26348 describes the structure of an image generating apparatus comprising a feeder capable of suppressing simultaneous feeding of a plurality of papers in paper feeding. In this image generating apparatus, an inclined member is arranged on a position opposite to a paper feed roller. Compression springs press the inclined member against the paper feed roller. The feeder separates papers carried by rotation of the paper feed roller into a fed paper and the remaining papers due to frictional resistance of an inclined portion of the inclined member. The paper feed roller carries only the fed paper in a paper feed direction. In the image generating apparatus described in Japanese Patent Laying-Open No. 2003-26348, therefore, the paper feed roller regularly rotates in the direction for feeding the papers, not to rotate oppositely thereto.

However, the feeder described in the aforementioned Japanese Patent Laying-Open No. 02-305727 must be separately provided with a large number of members such as the sheet separation roller, the press roller, the rotating arm, the spring, the wire, the solenoid and the like in addition to the members such as the paper feed roller and the feed roller, in order to separate the papers one by one from each other. Therefore, the number of components is disadvantageously increased.

The feeder described in the aforementioned Japanese Patent Laying-Open No. 06-64769 must also be separately provided with a large number of members such as the separation roller, the two compression springs, the support member, the lever, the solenoid and the like in addition to the members such as the paper feed roller and the feed roller, in order to separate the papers one by one from each other similarly to the aforementioned Japanese Patent Laying-Open No. 02-305727. Therefore, the number of components is disadvantageously increased.

In the image generating apparatus comprising the feeder described in the aforementioned Japanese Patent Laying-Open No. 2003-26348, on the other hand, the paper feed roller, rotating only in the direction for feeding the papers, disadvantageously also carries an extra paper other than the fed paper in the paper feed direction when the extra paper remains on the inclined member and the paper feed roller comes into contact with this extra paper. In this case, the paper feed roller disadvantageously doubly feeds the papers.

SUMMARY OF THE INVENTION

The present invention has been proposed in order to solve the aforementioned problems, and an object of the present invention is to provide an image generating apparatus capable of effectively suppressing double paper feeding and reducing the number of components.

In order to attain the aforementioned object, an image generating apparatus according to a first aspect of the present invention comprises a separation wall for separating papers one by one from each other, a paper feed roller feeding the papers, a push-up member pressing the papers against the paper feed roller and a control portion controlling driving of the paper feed roller and the push-up member by rotating the paper feed roller in a prescribed direction thereby carrying the papers in a paper feed direction, then rotating the paper feed roller oppositely to the prescribed direction while lifting the push-up member thereby carrying the papers oppositely to the paper feed direction by a prescribed distance and thereafter lowering the push-up member.

The image generating apparatus according to the first aspect, provided with the control portion rotating the paper feed roller in the prescribed direction thereby carrying the papers in the paper feed direction and then rotating the paper feed roller oppositely to the prescribed direction while lifting the push-up member thereby carrying the papers oppositely to the paper feed direction by the prescribed distance as hereinabove described so that the push-up member presses the papers against the paper feed roller, can easily carry a fed paper oppositely to the paper feed direction by rotating the paper feed roller oppositely to the prescribed direction. Further, the image generating apparatus, also moving a paper located under the fed paper oppositely to the paper feed direction due to frictional force between this paper and the fed paper following the operation of carrying the fed paper oppositely to the paper feed direction, can return the paper located under the fed paper to a position not beyond the separation wall. In addition, the image generating apparatus can downwardly move the paper, returned to the position not beyond the separation wall, located under the fed paper while lowering the push-up member by controlling the control portion to lower the push-up member after carrying the papers oppositely to the paper feed direction, thereby reliably separating the fed paper from the remaining papers. Consequently, the image generating apparatus can carry only the fed paper in the paper feed direction also when the remaining papers pass the separation wall due to insufficient separation of the papers through the separation wall, thereby effectively suppressing double paper feeding. Further, the image generating apparatus can separate the papers one by one from each other due to the separation wall for separating the papers one by one from each other and the control portion controlling driving of the paper feed roller and the push-up member, so that the same may not be separately provided with various members such as a separation roller, a compression spring, a lever and a solenoid for separating the papers from each other. Thus, the number of components can be inhibited from increase as compared with an image generating apparatus provided with various members such as a separation roller, a compression spring, a lever and a solenoid for separating the papers from each other.

In the aforementioned image generating apparatus according to the first aspect, the separation wall is preferably provided with an inclined portion for separating the papers from each other, for separating the papers one by one from each other by carrying the papers in the paper feed direction along the inclined portion and thereafter carrying the papers oppositely to the paper feed direction. According to this structure, the image generating apparatus can move the paper located under the fed paper in a direction for falling from the inclined portion of the separation wall by carrying the fed paper oppositely to the paper feed direction also when the paper located under the fed paper remains on a position beyond the inclined portion of the separation wall. Therefore, the image generating apparatus can inhibit the paper feed roller from carrying the papers other than the fed paper in the paper feed direction when carrying the fed paper to a printing start position, thereby effectively suppressing double paper feeding.

The aforementioned image generating apparatus according to the first aspect preferably further comprises a paper sensor for sensing the papers, a feed roller carrying the papers and a first motor driving the feed roller and the paper feed roller, and the control portion preferably recognizes a fed paper with a signal received from the paper sensor and controls driving of the first motor to carry the papers with the feed roller and the paper feed roller on the basis of the signal received from the paper sensor. According to this structure, the image generating apparatus can correctly recognize the position of the papers with the paper sensor, thereby correctly carrying the papers with the feed roller and the paper feed roller with reference to the recognized position. Thus, the image generating apparatus can carry the papers oppositely to the paper feed direction with the feed roller and the paper feed roller by a distance necessary for separating the fed paper and the paper located under the fed paper from each other, thereby more reliably separating the papers from each other.

The aforementioned image generating apparatus comprising the paper sensor, the feed roller and the first motor preferably further comprises a press roller pressing the feed roller, and the control portion preferably controls driving of the first motor to carry the papers oppositely to the paper feed direction with the feed roller and the paper feed roller while pressing the papers with the feed roller and the press roller. According to this structure, the image generating apparatus can correctly transmit the rotation of the feed roller to the papers pressed by the feed roller and the press roller. Consequently, the image generating apparatus can more correctly carry the papers by rotating the feed roller.

In the aforementioned image generating apparatus comprising the paper sensor, the feed roller and the first motor, the first motor preferably includes a stepping motor, the paper sensor is preferably arranged between the paper feed roller and the feed roller, and the control portion preferably drives the stepping motor by a prescribed pulse number on the basis of the signal received from the paper sensor after the paper feed roller carries the papers to the paper sensor, so that the paper feed roller carries the papers to a position carriable with the feed roller. According to this structure, the image generating apparatus can correctly carry the papers to the position carriable with the feed roller.

The aforementioned image generating apparatus comprising the paper sensor, the feed roller and the first motor preferably carries the papers oppositely to the paper feed direction by a prescribed distance and thereafter carries the papers in the paper feed direction with the feed roller. According to this structure, the image generating apparatus can correctly carry the papers in the paper feed direction with the feed roller having high feeding accuracy as an essential paper feed operation after carrying the papers oppositely to the paper feed direction for preventing double paper feeding.

The aforementioned image generating apparatus according to the first aspect preferably further comprises a second motor for driving the push-up member, and the control portion preferably vertically rotates the push-up member by controlling driving of the second motor. According to this structure, the image generating apparatus can vertically rotate the push-up member by driving the second motor provided independently of the first motor for carrying the papers, thereby controlling vertical rotation of the push-up member regardless of the operation of carrying the papers. Consequently, the image generating apparatus can easily carry the papers oppositely to the paper feed direction while lifting the push-up member.

In the aforementioned image generating apparatus according to the first aspect, the control portion preferably lowers the push-up member, and thereafter carries the papers in the paper feed direction to a printing start position. According to this structure, the image generating apparatus can reliably separate the fed paper and the remaining papers from each other for starting printing immediately after carrying the papers to the printing start position.

In this case, the image generating apparatus preferably further comprises a feed roller carrying the papers, while the control portion preferably lowers the push-up member and thereafter carries the papers in the paper feed direction to the printing start position with the feed roller. According to this structure, the image generating apparatus can correctly carry the papers to the printing start position with the feed roller.

An image generating apparatus according to a second aspect of the present invention comprises a paper feed roller feeding papers, a feed roller carrying the papers, a press roller pressing the feed roller, a first motor driving the feed roller and the paper feed roller, a push-up member pressing the papers against the paper feed roller, a second motor for driving the push-up member and a control portion controlling driving of the paper feed roller and the push-up member, as well as a separation wall provided with an inclined portion for separating the papers one by one from each other and a paper sensor for sensing the papers, and the control portion recognizes a fed paper with a signal received from the paper sensor for controlling driving of the first motor to carry the papers oppositely to a paper feed direction with the feed roller and the paper feed roller while pressing the papers with the feed roller and the press roller on the basis of the signal received from the paper sensor, drives the second motor thereby vertically rotating the push-up member, carries the papers in the paper feed direction by rotating the paper feed roller in a prescribed rotation, thereafter carries the papers oppositely to the paper feed direction by a prescribed distance by rotating the paper feed roller oppositely to the prescribed direction while lifting the push-up member, and thereafter lowers the push-up member.

The image generating apparatus according to the second aspect, provided with the control portion rotating the paper feed roller in the prescribed direction thereby carrying the papers in the paper feed direction and then rotating the paper feed roller oppositely to the prescribed direction while lifting the push-up member thereby carrying the papers oppositely to the paper feed direction by the prescribed distance as hereinabove described so that the push-up member presses the papers against the paper feed roller, can easily carry the fed paper oppositely to the paper feed direction by rotating the paper feed roller oppositely to the prescribed direction. Further, the image generating apparatus, also moving a paper located under the fed paper oppositely to the paper feed direction due to frictional force between this paper and the fed paper following the operation of carrying the fed paper oppositely to the paper feed direction, can return the paper located under the fed paper to a position not beyond the separation wall. In addition, the image generating apparatus can downwardly move the paper, returned to the position not beyond the separation wall, located under the fed paper while lowering the push-up member by controlling the control portion to lower the push-up member after carrying the papers oppositely to the paper feed direction, thereby reliably separating the fed paper from the remaining papers. Consequently, the image generating apparatus can carry only the fed paper in the paper feed direction also when the remaining papers pass the separation wall due to insufficient separation of the papers through the separation wall, thereby effectively suppressing double paper feeding. Further, the image generating apparatus can separate the papers one by one from each other due to the separation wall for separating the papers one by one from each other and the control portion controlling driving of the paper feed roller and the push-up member, so that the same may not be separately provided with various members such as a separation roller, a compression spring, a lever and a solenoid for separating the papers from each other. Thus, the number of components can be inhibited from increase as compared with an image generating apparatus provided with various members such as a separation roller, a compression spring, a lever and a solenoid for separating the papers from each other. Further, the separation wall is provided with the inclined portion for separating the papers from each other, for separating the papers one by one from each other by carrying the papers in the paper feed direction along the inclined portion and thereafter carrying the papers oppositely to the paper feed direction, whereby the image generating apparatus can move the paper located under the fed paper in a direction for falling from the inclined portion of the separation wall by carrying the fed paper oppositely to the paper feed direction also when the paper located under the fed paper remains on a position beyond the inclined portion of the separation wall. Therefore, the image generating apparatus can inhibit the paper feed roller from carrying the papers other than the fed paper in the paper feed direction when carrying the fed paper to a printing start position, thereby effectively suppressing double paper feeding.

According to the second aspect, further, the control portion recognizes the fed paper with the signal received from the paper sensor and controls driving of the first motor to carry the papers with the feed roller and the paper feed roller on the basis of the signal received from the paper sensor, whereby the image generating apparatus can correctly recognize the position of the papers with the paper sensor, thereby correctly carrying the papers with the feed roller and the paper feed roller with reference to the recognized position. Thus, the image generating apparatus can carry the papers oppositely to the paper feed direction with the feed roller and the paper feed roller by a distance necessary for separating the fed paper and the paper located under the fed paper from each other, thereby more reliably separating the papers from each other. In addition, the control portion controls driving of the first motor to carry the papers while pressing the papers with the feed roller and the press roller, whereby the image generating apparatus can correctly transmit the rotation of the feed roller to the papers pressed by the feed roller and the press roller. Consequently, the image generating apparatus can more correctly carry the papers by rotating the feed roller. Further, the control portion vertically rotates the push-up member by controlling driving of the second motor so that the image generating apparatus can vertically rotate the push-up member by driving the second motor provided independently of the first motor for carrying the papers, thereby controlling vertical rotation of the push-up member regardless of the operation of carrying the papers. Consequently, the image generating apparatus can easily carry the papers oppositely to the paper feed direction while lifting the push-up member.

In the aforementioned image generating apparatus according to the second aspect, the first motor preferably includes a stepping motor, the paper sensor is preferably arranged between the paper feed roller and the feed roller, and the control portion preferably drives the stepping motor by a prescribed pulse number on the basis of the signal received from the paper sensor after the paper feed roller carries the papers to the paper sensor, so that the paper feed roller carries the papers to a position carriable with the feed roller. According to this structure, the image generating apparatus can correctly carry the papers to the position carriable with the feed roller.

The aforementioned image generating apparatus according to the second aspect preferably carries the papers oppositely to the paper feed direction by a prescribed distance and thereafter carries the papers in the paper feed direction with the feed roller. According to this structure, the image generating apparatus can correctly carry the papers in the paper feed direction with the feed roller having high feeding accuracy as an essential paper feed operation after carrying the papers oppositely to the paper feed direction for preventing double paper feeding.

In the aforementioned image generating apparatus according to the second aspect, the control portion preferably lowers the push-up member, and thereafter carries the papers in the paper feed direction to a printing start position. According to this structure, the image generating apparatus can reliably separate the fed paper and the remaining papers from each other for starting printing immediately after carrying the papers to the printing start position.

In this case, the control portion preferably lowers the push-up member, and thereafter carries the papers in the paper feed direction to the printing start position with the feed roller. According to this structure, the image generating apparatus can correctly carry the papers to the printing start position with the feed roller.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings.

The structure of a thermal transfer printer according to the embodiment of the present invention is described with reference to FIGS. 1 to 17. According to this embodiment, the present invention is applied to the thermal transfer printer, which is an exemplary image generating apparatus.

Figure 1:
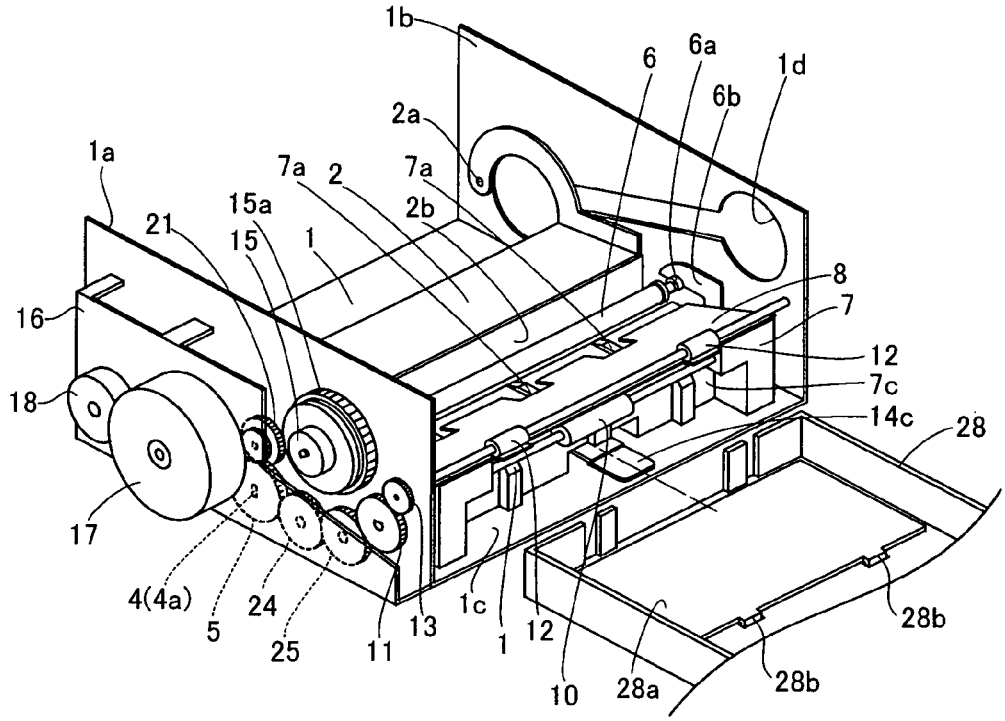
FIG. 1 is a perspective view showing the overall structure of a thermal transfer printer according to an embodiment of the present invention.
Figure 2:
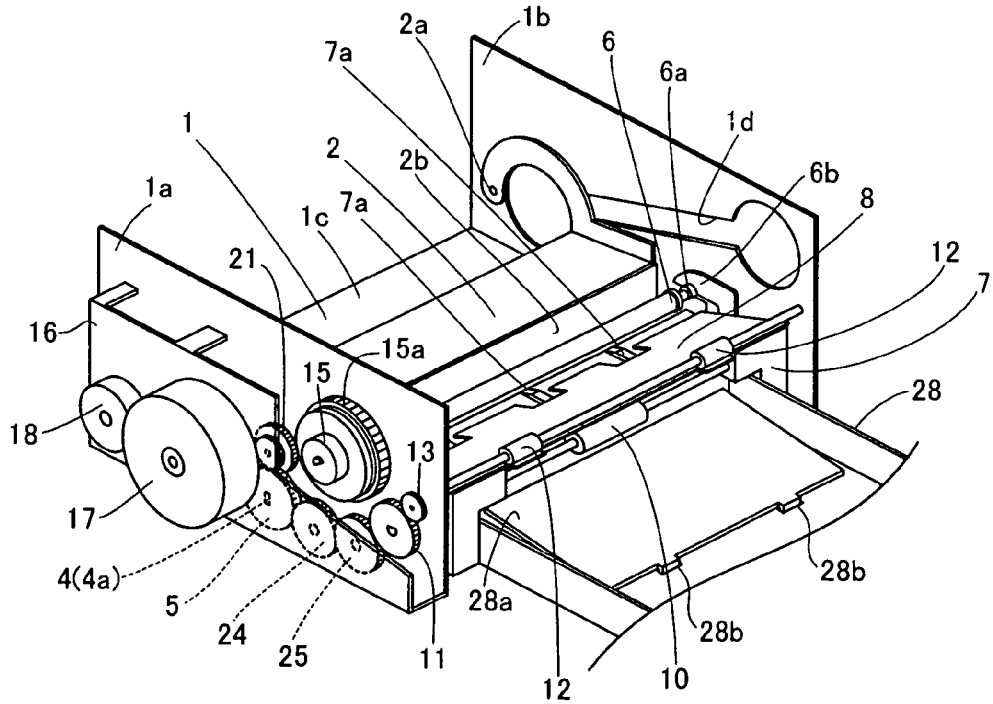
FIG. 2 is a perspective view showing the overall structure of the thermal transfer printer according to the embodiment shown in FIG. 1, to which a paper cassette is attached.

As shown in FIGS. 1 to 3 and 9, the thermal transfer printer according to this embodiment of the present invention comprises a chassis 1 of metal, a print head 2 for printing, a platen roller 3 (see FIG. 8) opposed to the print head 2; a feed roller 4 (see FIG. 12) of metal, a feed roller gear 5, a press roller 6 of metal pressing the feed roller 4 with prescribed pressing force, a lower paper guide 7 of resin, an upper paper guide 8 mounted on the lower paper guide 7, a paper feed roller 10 of rubber for feeding papers 9 (see FIG. 12), a paper feed roller gear 11, a paper discharge roller 12 of rubber, a paper discharge roller gear 13, a push-up member 14 of metal (sheet metal) for pressing the papers 9 against the paper feed roller 10, a take-up reel 15, a motor bracket 16, a paper feed motor 17 for carrying the papers 9, a push-up member drive motor 18 for rotating the print head 2, a drive gear 19 (see FIG. 8), an intermediate gear 20 (see FIG. 6) for transmitting driving force from the push-up member drive motor 18 to the drive gear 19, a swingable swing gear 21 (see FIG. 5), a plurality of intermediate gears 22 to 25 for transmitting driving force from the paper feed motor 17 to the paper feed roller gear 11, a control portion 26 (see FIG. 3) controlling operations of the thermal transfer printer and a power supply portion 27 for supplying power to the thermal transfer printer. A paper cassette case 28 of resin for storing the papers 9 fed to the thermal transfer printer is attached to the thermal transfer printer according to this embodiment, as shown in FIG. 2. The paper feed motor 17 and the push-up member drive motor 18 according to this embodiment are examples of the "first motor" and the "second motor" in the present invention respectively.

Figure 7:
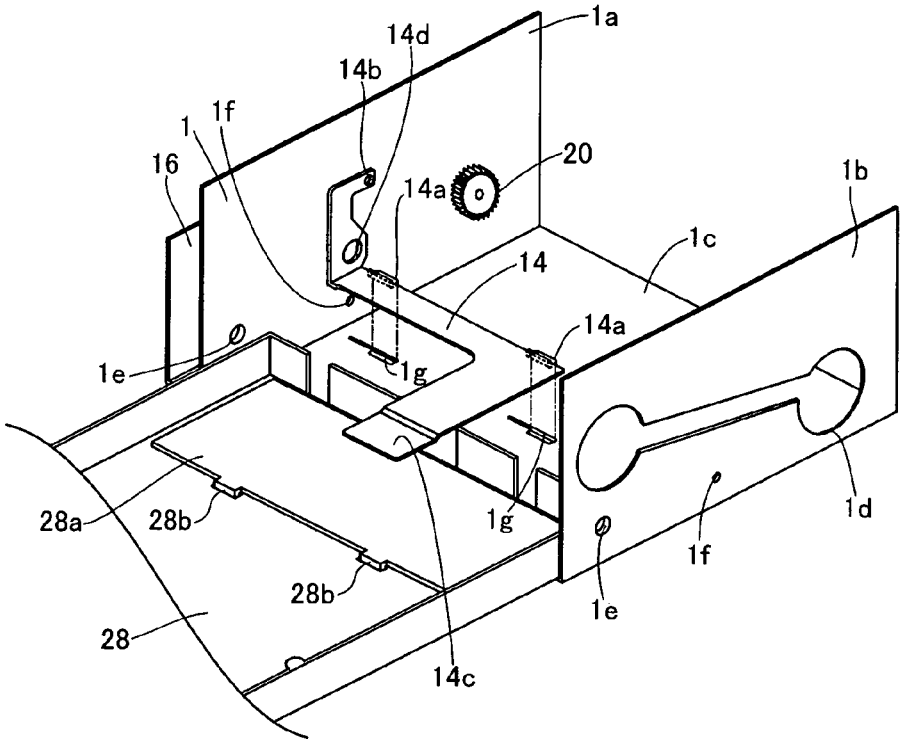
FIGS. 7 and 8 are total perspective views for illustrating a mounting structure of a push-up member of the thermal transfer printer according to the embodiment shown in FIG. 1.
Figure 8:
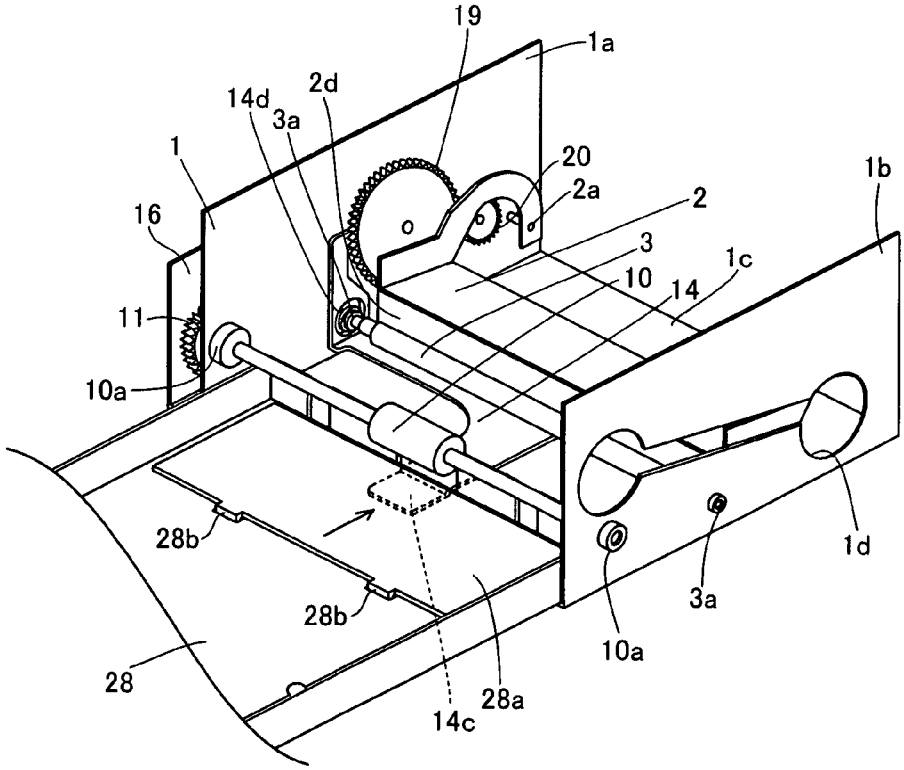

As shown in FIG. 2, the chassis 1 has a first side surface 1*a* mounted with the motor bracket 16, a second side surface 1*b* and a bottom surface 1*c* coupling the first and second side surfaces 1*a* and 1*b* with each other. An ink sheet cartridge receiving hole 1*d* is provided on the second side surface 1*b* of the chassis 1, for receiving an ink sheet cartridge 29 (see FIG. 17) storing an ink sheet 29*a* (see FIG. 17). As shown in FIG. 7, the first and second side surfaces 1*a* and 1*b* of the chassis 1 are provided with platen roller bearing mounting holes 1*e* and paper feed roller bearing mounting holes 1*f* respectively. As shown in FIG. 8, platen roller bearings 3*a* (see FIG. 8) rotatably supporting both ends of the platen roller 3 are mounted on the platen roller bearing mounting holes 1*e*. As shown in FIG. 8, further, paper feed roller bearings 10*a* rotatably supporting both ends of the paper feed roller 10 are mounted on the paper feed roller bearing mounting holes 1*f*. As shown in FIG. 7, engaging holes 1*g* are provided on the bottom surface 1*c* of the chassis 1, for receiving rotating shaft portions 14*a* of the push-up member 14.

As shown in FIG. 1, the print head 2 includes a support shaft 2*a*, a head portion 2*b* and a head cover 2*c* (see FIG. 17) of resin mounted on the head portion 2*b*. This print head 2 is mounted inside both side surfaces 1*a* and 1*b* of the chassis 1 to be rotatable about the support shaft 2*a*, as shown in FIG. 1. The platen roller bearings 3*a* mounted on both side surfaces 1*a* and 1*b* of the chassis 1 rotatably support the platen roller 3, as shown in FIG. 8.

Figure 5:
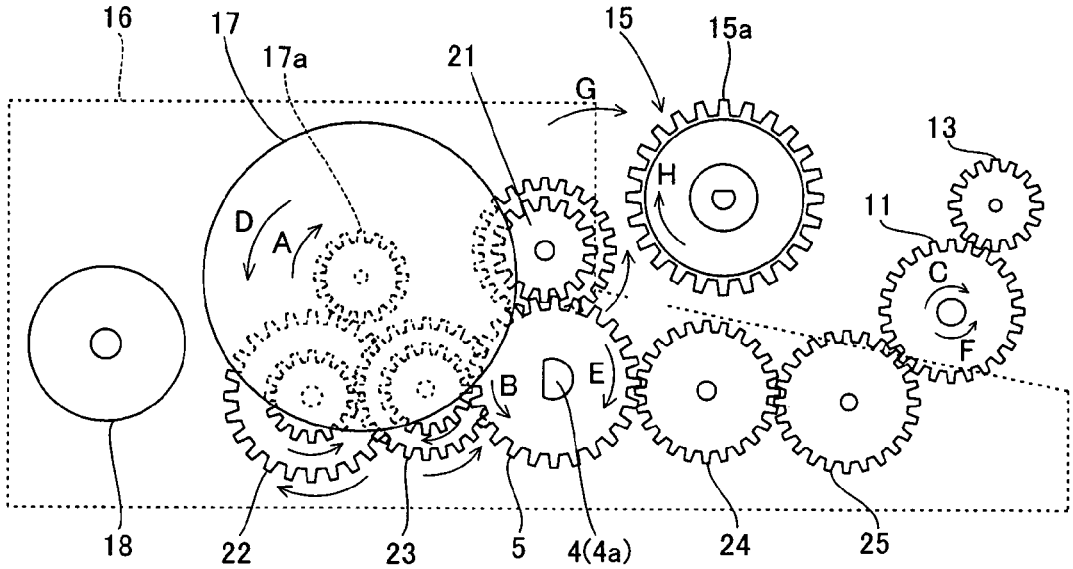
FIG. 5 is a front elevational view showing a stepping motor and respective gears of the thermal transfer printer according to the embodiment shown in FIG. 1.
Figure 6:
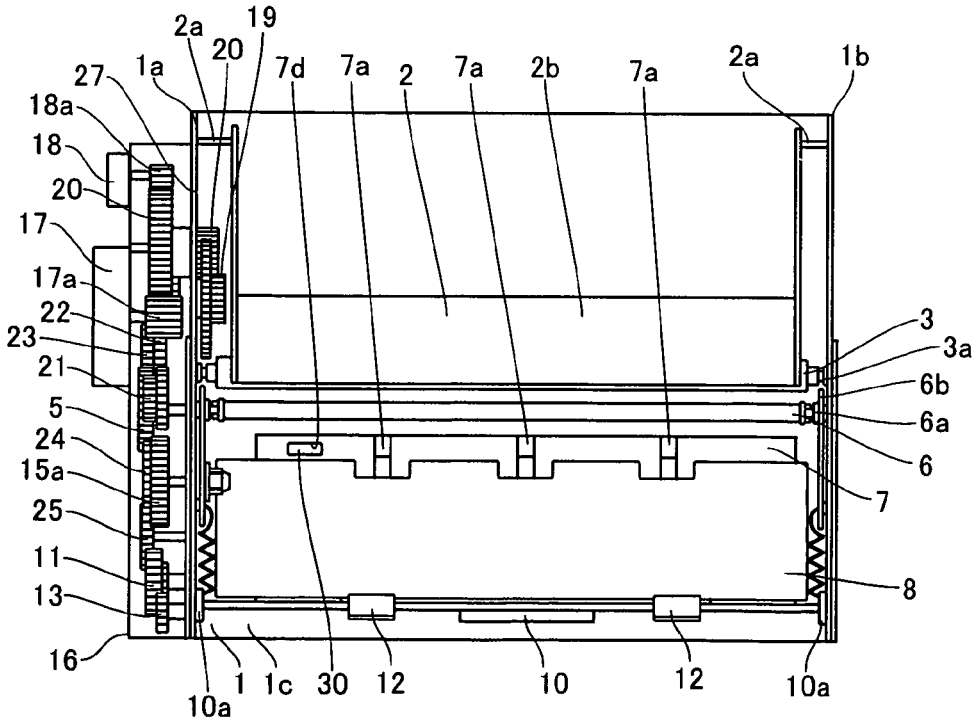
FIG. 6 is a plan view of the thermal transfer printer according to the embodiment shown in FIG. 1.

The feed roller 4 has a feed roller gear insert portion 4*a* inserted into the feed roller gear 5, as shown in FIG. 5. Feed roller bearings (not shown) mounted on the chassis 1 rotatably support the feed roller 4. Press roller bearings 6*a* rotatably support the press roller 6, as shown in FIGS. 2 and 6. The press roller bearings 6*a* are mounted on bearing support plates 6*b* arranged inside both side surfaces 1*a* and 1*b* of the chassis 1, to press the press roller 6 against the feed roller 4.

As show in FIG. 5, a motor gear 17*a* is mounted on a shaft portion of the paper feed motor 17 mounted on the motor bracket 16. The paper feed motor 17 functions as a drive source for driving a gear portion 15*a* of the take-up reel 15, the paper feed roller gear 11, the paper discharge roller gear 13 and the feed roller gear 5. The push-up member drive motor 18 has a function of vertically driving the push-up member 14. This push-up member drive motor 18 also has a function of driving a press member (not shown) pressing the print head 2 against the platen roller 3. Each of the paper feed motor 17 and the push-up member drive motor 18 is a stepping motor rotating in a prescribed step unit (angular unit) when supplied with a pulse signal.

Figure 9:
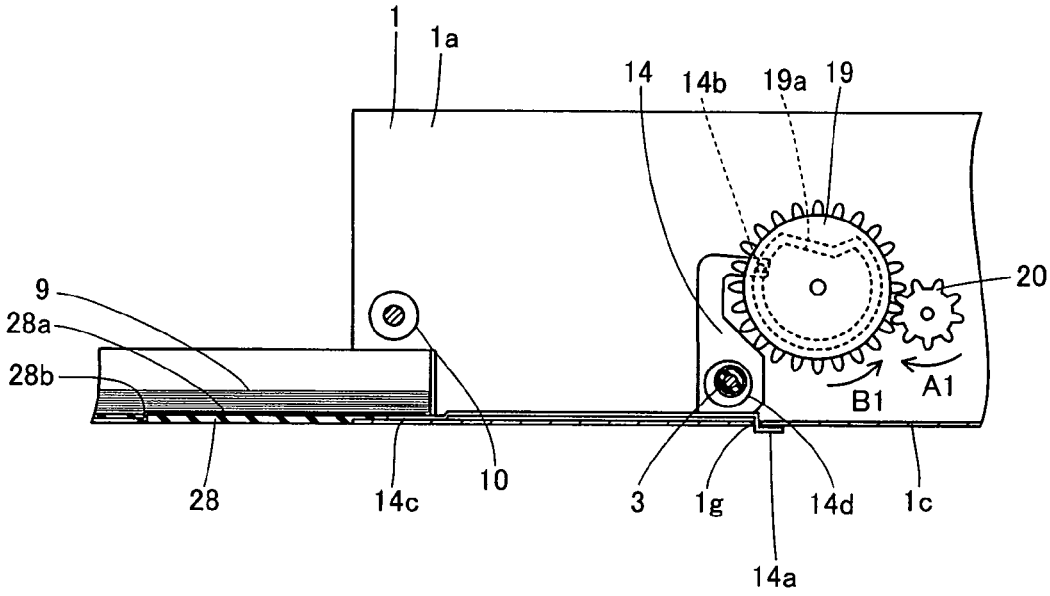
FIGS. 9 and 10 are sectional views for showing the structures of the push-up member and a drive gear of the thermal transfer printer according to the embodiment shown in FIG. 1.

As shown in FIG. 7, the push-up member 14 is provided with the two rotating shaft portions 14*a*, a protrusion 14*b* engaging with a cam groove 19*a* of the drive gear 19, a press portion 14*c* upwardly pressing a press plate 28*a* of the paper cassette case 28 and receiving holes 14*d* receiving the platen roller bearings 3*a*. As shown in FIG. 8, the receiving holes 14*d* have an inner diameter larger than the outer diameter of the platen roller bearings 3*a*, so that the push-up member 14 does not come into contact with the platen roller bearings 3*a* upon rotation. In order to mount the push-up member 14, the rotating shaft portions 14*a* of the push-up member 14 are first fitted into the engaging holes 1*g* provided on the bottom surface 1*c* of the chassis 1, as shown in FIG. 7. Thus, the push-up member 14 is mounted on the bottom surface 1*c* of the chassis 1, to be rotatable about the rotating shaft portions 14*a*. Then, the protrusion 14*b* of the push-up member 14 engages with the cam groove 19*a* of the drive gear 19, as shown in FIGS. 8 and 9. The drive gear 19 is mounted on the first side surface 1*a* of the chassis 1. The cam groove 19*a* (see FIG. 9) engaging with the protrusion 14*b* of the push-up member 14 is provided on the side (back surface) of the drive gear 19 closer to the first side surface 1*a* of the chassis 1.

According to this embodiment, the push-up member drive motor 18 drives the drive gear 19 through the gear 18*a* and the intermediate gear 20 thereby vertically rotating the push-up member 14, as shown in FIG. 6.

Figure 4:
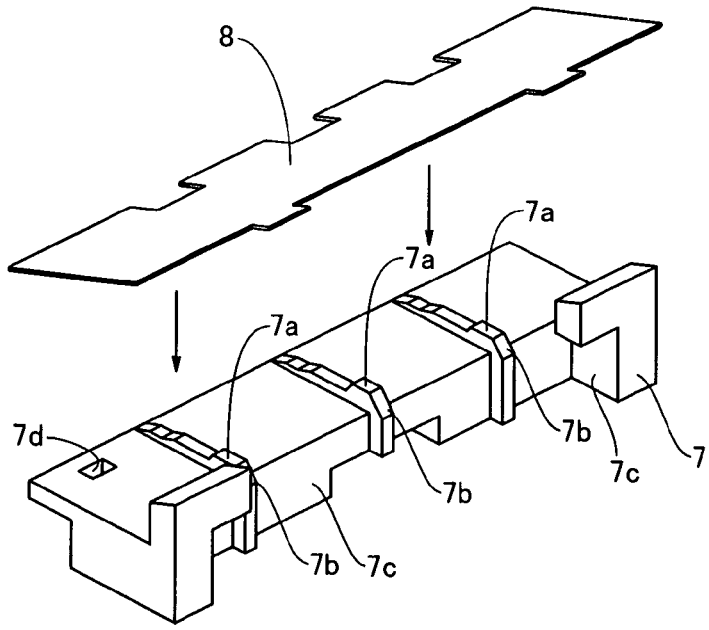
FIG. 4 is an exploded perspective view showing mounting structures of upper and lower paper guides of the thermal transfer printer according to the embodiment shown in FIG. 1.

As shown in FIG. 4, the lower paper guide 7 of resin is integrally provided with three separation walls 7*a* at prescribed intervals. The separation walls 7*a* have inclined portions 7*b*, for separating the papers 9 carried along the inclined portions 7*b* one by one from each other due to frictional resistance caused between the papers 9 and the inclined portions 7*b*. The upper paper guide 8 is mounted on the upper portion of the lower paper guide 7. The lower paper guide 7 is further provided with concave paper cassette case mounting portions 7*c* for mounting the paper cassette case 28, as shown in FIG. 4. As shown in FIGS. 4 and 6, the lower paper guide 7 is further provided with a hole 7*d* for receiving a paper sensor 30. In other words, the paper sensor 30 is arranged between the paper feed roller 10 and the feed roller 4 according to this embodiment.

The take-up reel 15 (see FIG. 1) engages with a take-up bobbin 29*c* arranged in a take-up portion 29*b* of the ink sheet cartridge 29 (see FIG. 17), thereby taking up the ink sheet 29*a* wound on the take-up bobbin 29*c*. As shown in FIG. 5, the gear portion 15*a* of the take-up reel 15 meshes with the swing gear 21 swinging along arrow G.

As shown in FIG. 2, the press plate 28*a* is provided on a prescribed position of the paper cassette case 28. This press plate 28*a* is rotatable about a fulcrum portion 28*b*. The press plate 28*a* is pushed up by the press portion 14*c* of the push-up member 14, thereby pressing the papers 9 against the paper feed roller 10.

Figure 12:
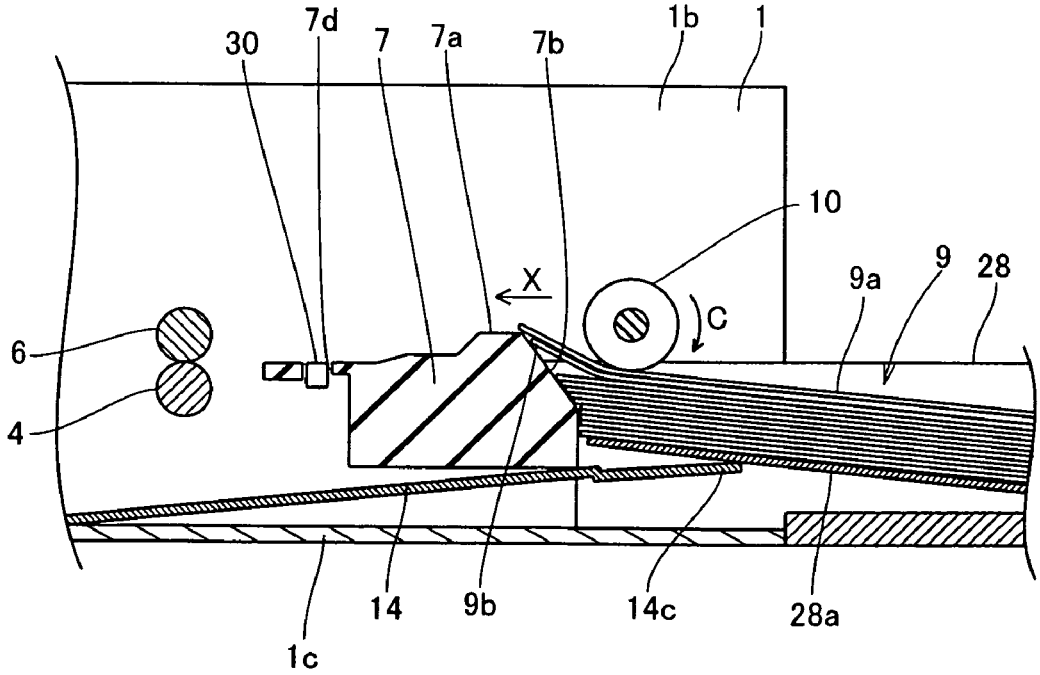
FIGS. 12 to 16 are sectional views for showing the paper carrying state of the thermal transfer printer according to the embodiment shown in FIG. 1.

As shown in FIG. 8, the paper feed roller 10 is arranged above the press plate 28*a* of the paper cassette case 28. As shown in FIG. 12, further, the paper feed roller 10 rotates along arrow C, thereby carrying the papers 9 in a paper feed direction (along arrow X in FIG. 12).

Figure 3:
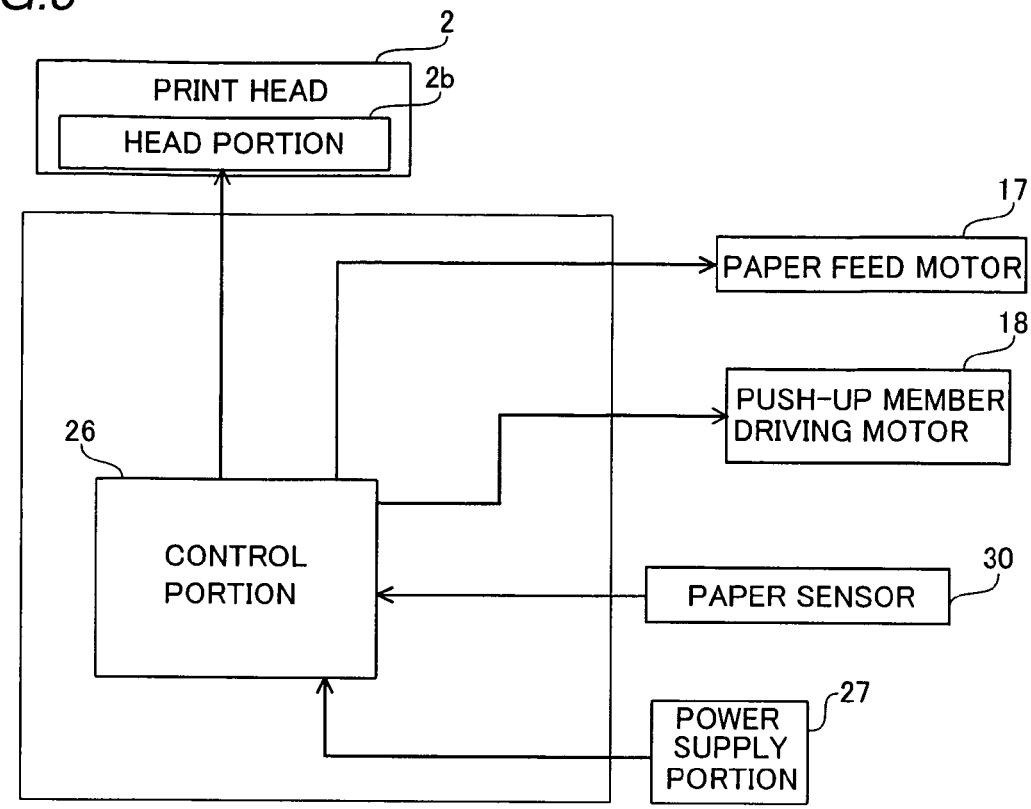
FIG. 3 is a block diagram showing the circuit structure of the thermal transfer printer according to the embodiment shown in FIG. 1.

The control portion 26 totally controlling the operations of the thermal transfer printer as shown in FIG. 3 is constituted of a CPU, a ROM and a RAM. The control portion 26 supplies prescribed pulse signals to the paper feed motor 17 and the push-up member drive motor 18 for rotating the paper feed motor 17 and the push-up member drive motor 18 by prescribed angles.

According to this embodiment, the control portion 26 controls driving of the paper feed motor 17 to carry the papers 9 in the paper feed direction and a direction opposite thereto. Further, the control portion 26 controls driving of the push-up member drive motor 18 for vertically rotating the push-up member 14 about the rotating shaft portions 14*a*. In addition, the control portion 26 recognizes the papers 9 through a signal received from the paper sensor 30, and carries the papers 9 by a prescribed distance on the basis of the signal received from the paper sensor 30.

Further, the control portion 26 controls the operations of the thermal transfer printer with power supplied from the power supply portion 27, as shown in FIG. 3. The control portion 26 searches for the ink sheet 29*a* of each color stored in the ink sheet cartridge 29 (see FIG. 17) with a sheet search sensor (not shown) before printing the ink sheet 29*a* of each color. The control portion 26 applies the supplied power to the head portion 2*b* of the print head 2 as a voltage pulse, thereby increasing the temperature of a heating element (not shown) provided on the head portion 2*b* of the print head 2. Thus, ink of the ink sheet 29*a* is melted and transferred to the papers 9.

A rotating operation of the thermal transfer printer according to this embodiment for the push-up member 14 is now described with reference to FIGS. 6 to 10.

As shown in FIG. 8, the paper cassette case 28 is attached to the thermal transfer printer so that the press plate 28*a* thereof is located on the press portion 14*c* of the push-up member 14.

Figure 10:
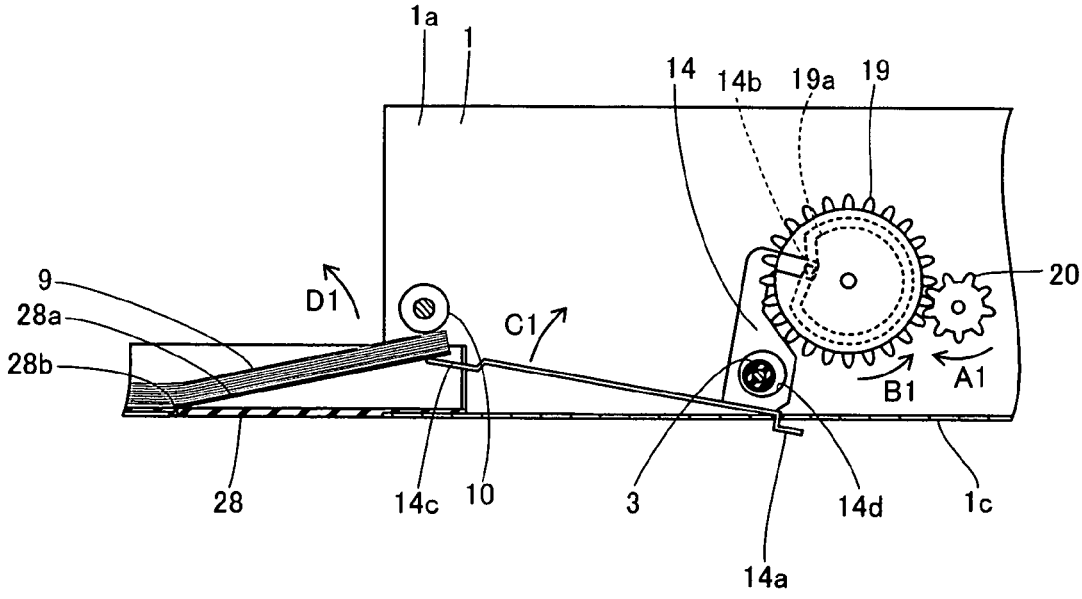

Then, the control portion 26 drives the push-up member drive motor 18 (see FIG. 6), thereby rotating the intermediate gear 20 (see FIG. 9) along arrow A1 through the gear 18*a* (see FIG. 6) for rotating the drive gear 19 along arrow B1. At this time, the push-up member 14 rotates along arrow C1 about the rotating shaft portions 14*a* as shown in FIG. 10 following the rotation of the drive gear 19 along arrow B1, due to the protrusion 14*b* engaging with the cam groove 19*a* of the drive gear 19. Thus, the press portion 14*c* of the push-up member 14 is lifted to rotate the press plate 28*a* of the paper cassette case 28 along arrow D1, thereby pressing the papers 9 having been stored in the paper cassette case 28 against the paper feed roller 10.

The operations of the thermal transfer printer according to the embodiment of the present invention are described with reference to FIGS. 5 and 11 to 18. At a step S1 in FIG. 18, the control portion 26 determines whether or not the power supply portion 27 of the thermal transfer printer is in an ON-state. If the power supply portion 27 is in an OFF-state, the control portion 26 repeats this determination until the power supply portion 27 enters an ON-state. When the power supply portion 27 enters an ON-state, the control portion 26 initializes data recorded in the RAM (not shown) or the like at a step S2. At a step S3, the control portion 26 determines whether or not a print button (not shown) is pressed, and repeats this determination until the print button is pressed if the same is not pressed. When determining that the print button is pressed at the step S3, the control portion 26 lifts the push-up member 14 at a step S4 through the aforementioned rotating operation for the push-up member 14.

Figure 11:
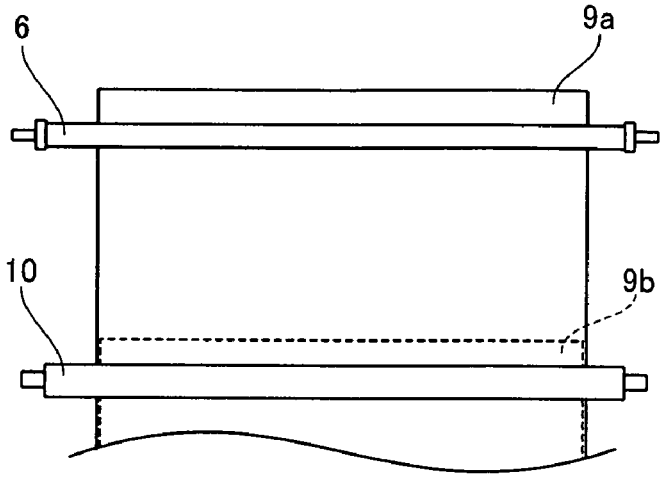
FIG. 11 is a plan view for showing a paper carrying state of the thermal transfer printer according to the embodiment shown in FIG. 1.

The lifted push-up member 14 lifts the press plate 28*a* of the paper cassette case 28 for pressing the papers 9 (9*a*) stored in the paper cassette case 28 against the paper feed roller 10, as shown in FIG. 12. Following driving of the paper feed motor 17, the motor gear 17*a* mounted thereon rotates along arrow A to rotate the feed roller gear 5 along arrow B through the intermediate gears 22 and 23 while rotating the paper feed roller gear 11 along arrow C through the intermediate gears 24 and 25, as shown in FIG. 5. Thus, the paper feed roller 10 rotates along arrow C for carrying the papers 9 pressed against the paper feed roller 10 in the paper feed direction (along arrow X), as shown in FIG. 12. Following a first paper 9*a* carried in the paper feed direction (along arrow X), a second paper 9*b* is also carried in the paper feed direction (along arrow X) due to frictional resistance caused between the first and second papers 9*a* and 9*b*. When the first and second papers 9*a* and 9*b* are carried along the inclined portions 7*b* of the separation walls 7*a*, frictional resistance caused between the inclined portions 7*b* of the separation walls 7*a* and the second paper 9*b* exceeds that caused between the first and second papers 9*a* and 9*b*, to separate the first and second papers 9*a* and 9*b* from each other. In this state, the first and second papers 9*a* and 9*b* deviate from each other with respect to the paper feed direction, as shown in FIG. 11.

Figure 13:
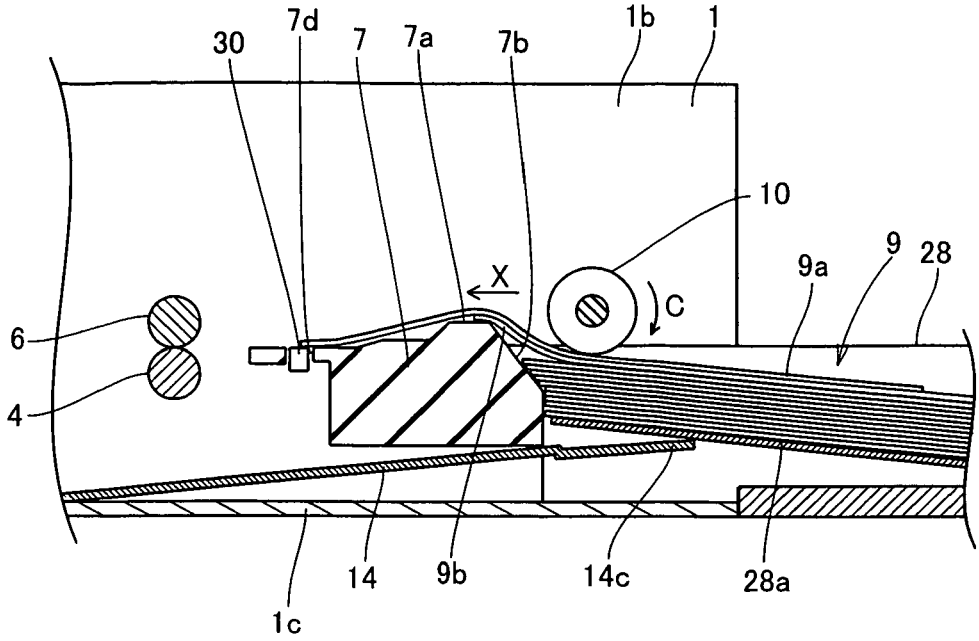
Figure 18:
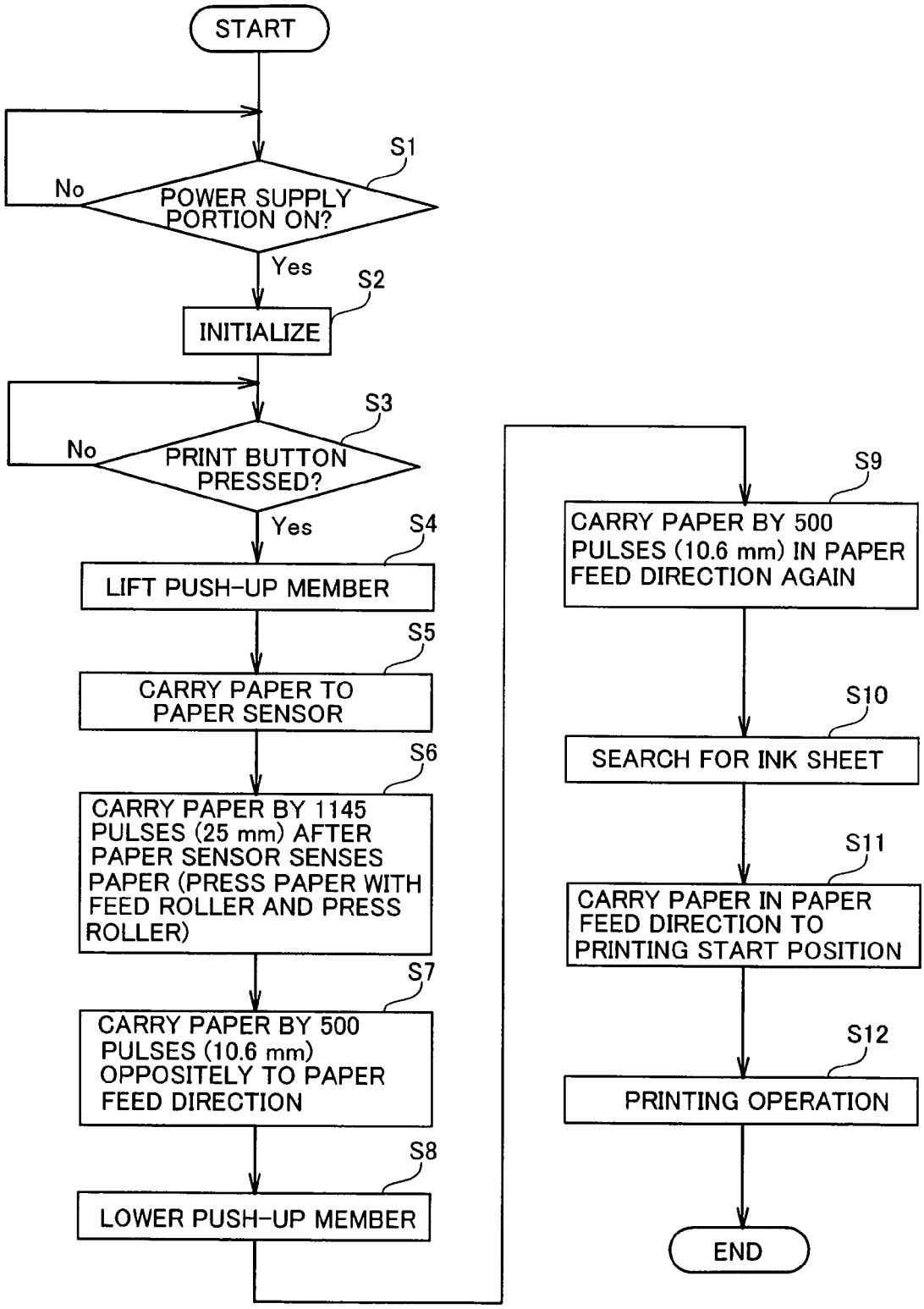
FIG. 18 is a flow chart for illustrating an operation of the thermal transfer printer according to the embodiment shown in FIG. 1.

At a step S5 shown in FIG. 18, the control portion 26 further rotates the paper feed roller 10 along arrow C, thereby further carrying the first paper 9*a* in the paper feed direction (along arrow X). When the forward end of the first paper 9*a* reaches the paper sensor 30 as shown in FIG. 13, the paper sensor 30 senses the first paper 9*a* and transmits a signal to the control portion 26. Following this carrying of the first paper 9*a* in the paper feed direction (along arrow X), the second paper 9*b* is also carried in the paper feed direction (along arrow X) over the inclined portions 7*b* of the separation walls 7*a*.

Figure 14:
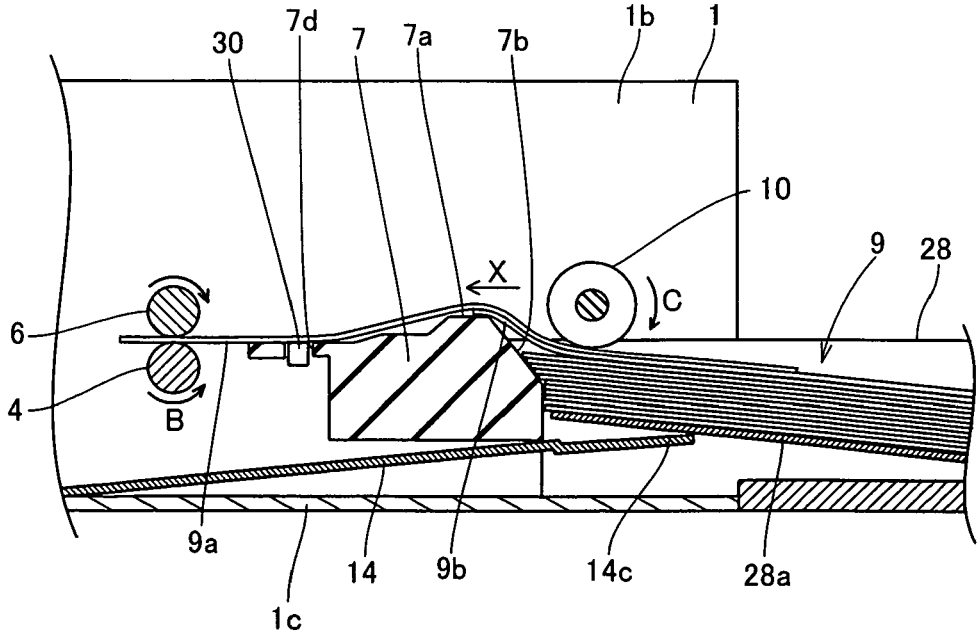

At a step S6, the control portion 26 supplies a pulse signal of 1145 pulses from the time when the paper sensor 30 has sensed the first paper 9*a*. Thus, the control portion 26 carries the first paper 9*a* by 25 mm in the paper feed direction (along arrow X) from the position where the paper sensor 30 has sensed this paper 9*a*. Therefore, the feed roller 4 and the press roller 6 press the first paper 9*a* so that the paper 9*a* is carriable, as shown in FIG. 14.

Figure 15:
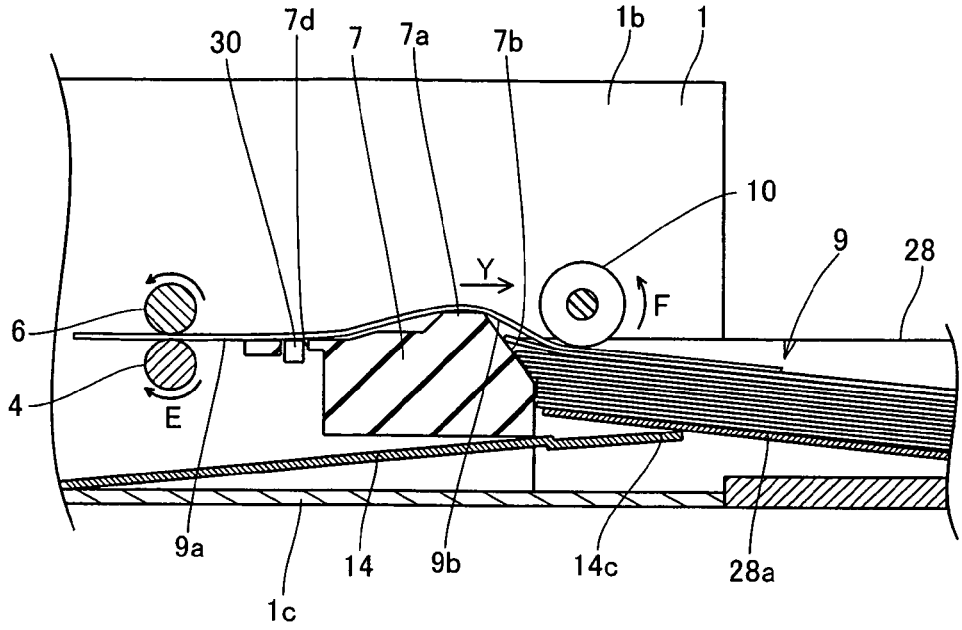

At a step S7, the control portion 26 supplies a pulse signal of 500 pulses to the paper feed motor 17, in order to carry the first paper 9*a* oppositely to the paper feed direction (along arrow Y in FIG. 15). Following this driving of the paper feed motor 17, the motor gear 17*a* mounted thereon rotates along arrow D for rotating the feed roller gear 5 along arrow E through the intermediate gears 22 and 23 while rotating the paper feed roller gear 11 along arrow F through the intermediate gears 24 and 25, as shown in FIG. 5. Thus, the feed roller 4 and the paper feed roller 10 carry the first paper 9*a* by 10.6 mm oppositely to the paper feed direction (along arrow Y), as shown in FIG. 15. In this state, the push-up member 14 is lifted as shown in FIG. 15, to press the papers 9 (9*a* and 9*b*) against the paper feed roller 10. Thus, the frictional resistance between the first and second papers 9*a* and 9*b* exceeds that before the press member 14 presses the papers 9 (9*a* and 9*b*) against the paper feed roller 10, whereby the second paper 9*b* is also carried oppositely to the paper feed direction (along arrow Y) following the opposite carried the first paper 9*a*, and returned to a position not beyond the inclined portions 7*b* of the separation walls 7*a*. When the first paper 9*a* is carried by 10.6 mm oppositely to the paper feed direction, the feed roller 4 can carry the first paper 9*a* in the paper feed direction.

Figure 16:
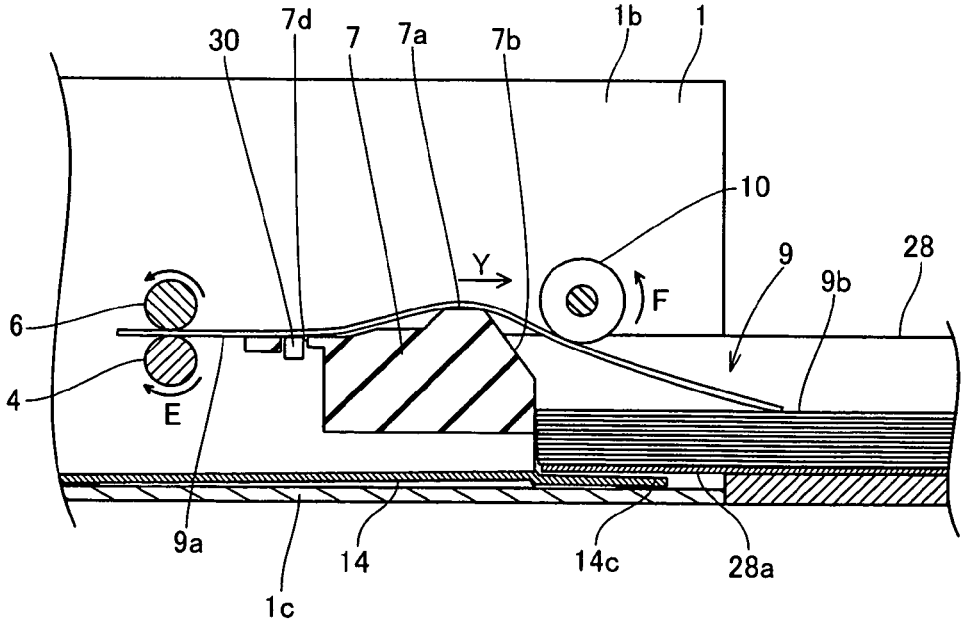

At a step S8, the control portion 26 lowers the push-up member through the aforementioned rotating operation for the push-up member 14. Thus, the control portion 26 also lower the second paper 9*b* and the subsequent papers 9 in addition to the first paper 9*a* as shown in FIG. 16, for detaching the second paper 9*b* and the subsequent papers 9 from the paper feed roller 10 thereby separating the second paper 9*b* and the subsequent papers 9 from the first paper 9*a*. At a step S9, the control portion 26 supplies a pulse signal of 500 pulses to the paper feed motor 17 so that the feed roller 4 carries the first paper 9*a* by 10.6 mm in the paper feed direction (along arrow X). Thus, the control portion 26 returns the first paper 9*a* in the paper feed direction by the distance carried oppositely thereto (along arrow Y).

Figure 17:
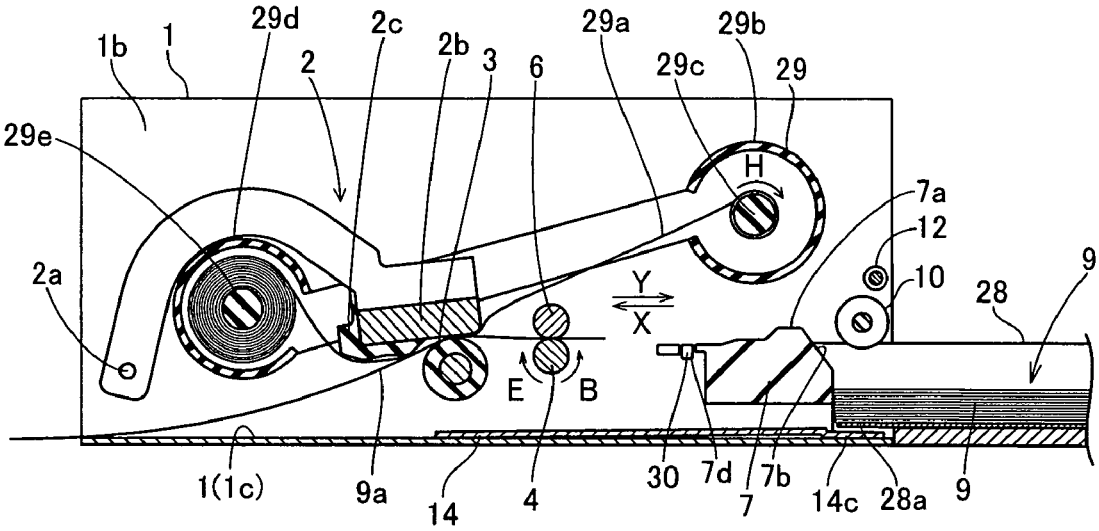
FIG. 17 is a sectional view of the thermal transfer printer according to the embodiment shown in FIG. 1.

At a step S10, the control portion 26 searches for the ink sheet 29*a* with the sheet search sensor (not shown). At a step S11, the control portion 26 carries the first paper 9*a* in the paper feed direction (along arrow X in FIG. 17) up to a printing start position by rotating the feed roller 4 along arrow B as shown in FIG. 17. Then, the control portion 26 performs a normal printing operation at a step S12.

In the normal printing operation, the control portion 26 first drives the paper feed motor 17 to rotate the motor gear 17*a* mounted thereon along arrow D for rotating the feed roller gear 5 along arrow E through the intermediate gears 22 and 23, as shown in FIG. 5. Thus, the control portion 26 carries the first paper 9*a* in a paper discharge direction (opposite to the paper feed direction: along arrow Y in FIG. 17) through the feed roller 4 rotating along arrow E following the rotation of the roller gear 5 (see FIG. 5). The swingable swing gear 21 (see FIG. 5) swings along arrow G in FIG. 5, to mesh with the gear portion 15*a* of the take-up reel 15. Thus, the gear portion 15*a* of the take-up reel 15 rotates along arrow H in FIG. 5, for taking up the ink sheet 29*a* wound on a feed portion 29*e* of the feed bobbin 29*d* on the take-up portion 29*b* of the take-up bobbin 29*c*.

At this time, the gear 18*a*, the intermediate gear 20 and the drive gear 19 (see FIG. 6) rotate a press member (not shown) following driving of the push-up member drive motor 18, thereby rotating the print head 2 toward the platen roller 3. Thus, the head portion 2*b* is pressed against the platen roller 3 through the ink sheet 29*a* and the first paper 9*a*. Then, the control portion 26 carries the first paper 9*a* in the paper discharge direction (opposite to the paper feed direction: along arrow Y in FIG. 17) while taking up the ink sheet 29*a*, so that the head portion 2*b* of the print head 2 prints the ink from the ink sheet 29*a* on the first paper 9*a*. In paper discharge, the paper discharge roller 12 discharges the completely printed first paper 9*a*.

At the step S12, the control portion 26 completes the normal printing operation, thereby completing the operations of the thermal transfer printer according to this embodiment.

According to this embodiment, as hereinabove described, the control portion 26, carrying the first paper 9*a* by 10.6 mm oppositely to the paper feed direction (along arrow Y in FIG. 15) by rotating the paper feed roller 10 along arrow C in FIG. 14 thereby carrying the first paper 9*a* in the paper feed direction (along arrow X in FIG. 14) and thereafter rotating the paper feed roller 10 along arrow F in FIG. 15 while lifting the push-up member 14, can easily carry the fed paper 9*a* oppositely to the paper feed direction (along arrow Y in FIG. 15) by rotating the paper feed roller 10 along arrow F in FIG. 15 since the push-up member 14 presses the paper 9*a* against the paper feed roller 10. The second paper 9*b* located under the first paper 9*a*, also carried oppositely to the paper feed direction (along arrow Y in FIG. 15) following the oppositely carried first paper 9*a* due to the frictional force between the same and the first paper 9*a*, can be returned to the position not beyond the separation walls 7*a*. Further, the control portion 26 can lower the second paper 9*a* returned to the position not beyond the separation walls 7*a* and the subsequent papers 9 by lowering the push-up member 14 after carrying the papers 9 oppositely to the paper feed direction (along arrow Y in FIG. 15), thereby reliably separating the first paper 9*a* and the remaining papers 9 from each other. Consequently, the control portion 26 can carry only the first paper 9*a* in the paper feed direction also when the second paper 9*b* passes the separation walls 7*a* due to insufficient separation of the papers 9 through the separation walls 7*a*, thereby effectively suppressing double feeding of the papers.

According to this embodiment, the thermal transfer printer can separate the papers 9 one by one from each other due to the separation walls 7*a* for separating the papers 9 one by one from each other and the control portion 26 controlling driving of the paper feed roller 10 and the push-up member 14, so that the same may not be separately provided with various members such as a separation roller, a compression spring, a lever and a solenoid in order to separate the papers 9 from each other. Therefore, the number of components can be inhibited from increase as compared with a case of providing various members such as a separation roller, a compression spring, a lever and a solenoid in order to separate the papers 9 from each other.

According to this embodiment, the thermal transfer printer, having the inclined portions 7*b* provided on the separation walls 7*a* for separating the papers 9 one by one from each other by carrying the papers 9 in the paper feed direction (along arrow X in FIG. 14) along the inclined portions 7*b* and thereafter carrying the same oppositely to the paper feed direction (along arrow Y in FIG. 15), can move the second paper 9*b* in a direction for falling from the inclined portions 7*b* of the separation walls 7*a* by carrying the first paper 9*a* oppositely to the paper feed direction also when the second paper 9*b* remains on a position beyond the inclined portions 7*b* of the separation walls 7*a*. Therefore, the thermal transfer printer can inhibit the paper feed roller 10 from carrying the second paper 9*b* in the paper feed direction (along arrow X in FIG. 14) when carrying the first paper 9*a* to the printing start position, thereby effectively suppressing double feeding of the papers 9.

According to this embodiment, the control portion 26 recognizes the fed paper 9*a* through the signal received from the paper sensor 30 and controls driving of the paper feed motor 17 to carry the papers 9 with the feed roller 4 and the paper feed roller 10 on the basis of the signal received from the paper sensor 30 so that the feed roller 4 and the paper feed roller 10 can correctly carry the papers 9 with reference to the position thereof correctly recognized by the paper sensor 30. Therefore, the thermal transfer printer can correctly carry the papers 9 oppositely to the paper feed direction (along arrow Y in FIG. 12) with the feed roller 4 and the paper feed roller 10 by a distance necessary for separating the first and second papers 9*a* and 9*b* from each other, thereby more reliably separating the papers 9 from each other.

According to this embodiment, the control portion 26 controls driving of the paper feed motor 17 to carry the papers 9 while pressing the same with the feed roller 4 and the press roller 6, whereby the thermal transfer printer can correctly transmit the rotation of the feed roller 4 to the papers 9 pressed by the feed roller 4 and the press roller 6. Consequently, the thermal transfer printer can more correctly carry the papers 9 by rotating the feed roller 4.

According to this embodiment, the control portion 26 vertically rotates the push-up member 14 by controlling driving of the push-up member drive motor 18 so that the thermal transfer printer can vertically rotate the push-up member 14 by driving the push-up member drive motor 18 provided independently of the paper feed motor 17 for carrying the papers 9, thereby controlling vertical rotation of the push-up member 14 regardless of the operation of carrying the papers 9. Consequently, the thermal transfer printer can easily carry the papers 9 oppositely to the paper feed direction while lifting the push-up member 14.

Although the present invention has been described and illustrated in detail, it is clearly understood that the same is by way of illustration and example only and is not to be taken by way of limitation, the spirit and scope of the present invention being limited only by the terms of the appended claims.

For example, while the aforementioned embodiment is applied to the thermal transfer printer employed as an exemplary image generating apparatus, the present invention is not restricted to this but is also applicable to another image generating apparatus such as an ink jet printer or a later printer, so far as the same comprises a feeder.

While the thermal transfer printer carries the papers by the prescribed distance on the basis of the signal received from the paper sensor in the aforementioned embodiment, the present invention is not restricted to this but the control portion may alternatively carry the papers by the prescribed distance without employing the paper sensor.

While the thermal transfer printer carries the papers by the prescribed distance oppositely to the paper feed direction while pressing the papers with the feed roller and the press roller in the aforementioned embodiment, the present invention is not restricted to this but the thermal transfer printer may alternatively carry the papers by the prescribed distance oppositely to the paper feed direction only with the paper feed roller.

While the push-up member drive motor also has the function of rotating the press member pressing the print head in the aforementioned embodiment, the present invention is not restricted to this but a dedicated motor may alternatively be provided for driving only the push-up member. Further alternatively, a drive source other than the motor may vertically drive the push-up member.

While the thermal transfer printer senses the first paper with the paper sensor, then carries the first paper by 25 mm in the paper feed direction and thereafter carries the first paper by 10.6 mm oppositely to the paper feed direction in the aforementioned embodiment, the present invention is not restricted to this but the thermal transfer printer may alternatively carry the first paper by distances other than the above so far as the same can separate the papers one by one from each other.

What is claimed is:

1. An image generating apparatus comprising:

a separation wall for separating papers one by one from each other;

a paper feed roller feeding configured to carry said papers to said separation wall;

a push-up member pressing said papers against said paper feed roller; and a control portion controlling driving of said paper feed roller and said push-up member by rotating said paper feed roller in a prescribed direction in paper printing thereby carrying said papers before printing in a paper feed direction, then rotating said paper feed roller oppositely to said prescribed direction while lifting said push-up member thereby carrying said papers before printing oppositely to said paper feed direction by a prescribed distance and thereafter lowering said push-up member.

2. The image generating apparatus according to claim 1, wherein said separation wall is provided with an inclined portion for separating said papers from each other, for separating said papers one by one from each other by carrying said papers in said paper feed direction along said inclined portion and thereafter carrying said papers oppositely to said paper feed direction.

3. The image generating apparatus according to claim 1, further comprising a paper sensor for sensing said papers, a feed roller carrying said papers and a first motor driving said feed roller and said paper feed roller, wherein said control portion recognizes fed said paper with a signal received from said paper sensor and controls driving of said first motor to carry said papers with said feed roller and said paper feed roller on the basis of said signal received from said paper sensor.

4. The image generating apparatus according to claim 3, further comprising a press roller pressing said feed roller, wherein said control portion controls driving of said first motor to carry said papers oppositely to said paper feed direction with said feed roller and said paper feed roller while pressing said papers with said feed roller and said press roller.

5. The image generating apparatus according to claim 3, wherein said first motor includes a stepping motor, said paper sensor is arranged between said paper feed roller and said feed roller, and said control portion drives said stepping motor by a prescribed pulse number on the basis of said signal received from said paper sensor after said paper feed roller carries said papers to said paper sensor, so that said paper feed roller carries said papers to a position carriable with said feed roller.

6. The image generating apparatus according to claim 3, carrying said papers oppositely to said paper feed direction by a prescribed distance and thereafter carrying said papers in said paper feed direction with said feed roller.

7. An image generating apparatus comprising a separation wall for separating papers one by one from each other;

a paper feed roller feeding said papers to said separation wall;

a push-up member pressing said papers against said paper feed roller; and a control portion controlling driving of said paper feed roller and said push-up member by rotating said paper feed roller in a prescribed direction thereby carrying said papers in a paper feed direction, then rotating said paper feed roller oppositely to said prescribed direction while lifting said push-up member thereby carrying said papers oppositely to said paper feed direction by a prescribed distance and thereafter lowering said push-up member comprising further comprising a second motor for driving said push-up member, wherein said control portion vertically rotates said push-up member by controlling driving of said second motor.

8. The image generating apparatus according to claim 1, wherein said control portion lowers said push-up member, and thereafter carries said papers in said paper feed direction to a printing start position.

9. The image generating apparatus according to claim 8, further comprising a feed roller carrying said papers, wherein said control portion lowers said push-up member, and thereafter carries said papers in said paper feed direction to said printing start position with said feed roller.

10. An image generating apparatus comprising:

a paper feed roller feeding papers;

a feed roller carrying said papers;

a press roller pressing said feed roller;

a first motor driving said feed roller and said paper feed roller;

a push-up member pressing said papers against said paper feed roller;

a second motor for driving said push-up member; and a control portion controlling driving of said paper feed roller and said push-up member;

a separation wall provided with an inclined portion for separating said papers one by one from each other; and a paper sensor for sensing said papers, wherein said control portion recognizes fed said paper with a signal received from said paper sensor for controlling driving of said first motor to carry said papers oppositely to a paper feed direction with said feed roller and said paper feed roller while pressing said papers with said feed roller and said press roller on the basis of said signal received from said paper sensor, drives said second motor thereby vertically rotating said push-up member, carries said papers in said paper feed direction by rotating said paper feed roller in a prescribed rotation, thereafter carries said papers oppositely to said paper feed direction by a prescribed distance by rotating said paper feed roller oppositely to said prescribed direction while lifting said push-up member, and thereafter lowers said push-up member.

11. The image generating apparatus according to claim 10, wherein said first motor includes a stepping motor, said paper sensor is arranged between said paper feed roller and said feed roller, and said control portion drives said stepping motor by a prescribed pulse number on the basis of said signal received from said paper sensor after said paper feed roller carries said papers to said paper sensor, so that said paper feed roller carries said papers to a position carriable with said feed roller.

12. The image generating apparatus according to claim 10, carrying said papers oppositely to said paper feed direction by a prescribed distance and thereafter carrying said papers in said paper feed direction with said feed roller.

13. The image generating apparatus according to claim 10, wherein said control portion lowers said push-up member, and thereafter carries said papers in said paper feed direction to a printing start position.

14. The image generating apparatus according to claim 13, wherein said control portion lowers said push-up member, and thereafter carries said papers in said paper feed direction to said printing start position with said feed roller.

* * * * *